US005918417A

United States Patent [19]

Kinder

[11] Patent Number: 5,918,417

[45] Date of Patent: Jul. 6, 1999

[54] ARCHED WINDOW SHUTTER

[76] Inventor: Susan E. Kinder, P.O. Box 799003, Dallas, Tex. 75359

[21] Appl. No.: 09/060,890

[22] Filed: Apr. 15, 1998

[51] Int. Cl.[6] ..... E06B 7/02

[52] U.S. Cl. ..... 49/39; 160/DIG. 16

[58] Field of Search ..... 49/38, 39; 454/220, 454/221, 224, 225; 160/DIG. 16; 292/251.5; 70/277, 276

[56] References Cited

U.S. PATENT DOCUMENTS

| | | | |
|---|---|---|---|
| 3,022,549 | 2/1962 | Cummings | 160/DIG. 16 X |
| 3,129,471 | 4/1964 | Johnson et al. | 160/DIG. 16 X |
| 3,153,819 | 10/1964 | Bond | 160/DIG. 16 X |
| 4,699,195 | 10/1987 | Lester | 160/134 |
| 4,776,380 | 10/1988 | Lester | 160/134 |
| 4,848,812 | 7/1989 | Slaughter | 292/251.5 X |
| 4,919,464 | 4/1990 | Richards | 292/251.5 |
| 5,086,822 | 2/1992 | Keighler | 160/38 |
| 5,117,889 | 6/1992 | Coe | 160/134 |
| 5,139,070 | 8/1992 | Kidd | 160/84 |
| 5,159,966 | 11/1992 | Fleishman | 160/84 |
| 5,168,912 | 12/1992 | Jelic et al. | 160/84 |
| 5,183,092 | 2/1993 | Jelic | 160/84 |
| 5,429,404 | 7/1995 | King | 160/DIG. 16 X |
| 5,471,789 | 12/1995 | Faircloth | 49/74 |
| 5,485,733 | 1/1996 | Hoffman | 292/251.5 X |
| 5,564,229 | 10/1996 | Noska | 49/39 |
| 5,584,329 | 12/1996 | Thomas | 160/134 |
| 5,662,153 | 9/1997 | Rosenblatt | 160/84 |
| 5,713,156 | 2/1998 | Briggs, Sr. | 49/82 |

*Primary Examiner*—Jerry Redman
*Attorney, Agent, or Firm*—Dennis Griggs

[57] ABSTRACT

A shutter assembly for installation across an arched window includes a fixed shutter and a movable shutter coupled to the fixed shutter for rotation between open and closed positions. A permanent magnet is attached to the movable shutter for opposite-pole magnetic attraction coupling with a permanent magnet carried on a portable, hand-held actuator. The movable shutter is engaged magnetically and indirectly by placing the actuator end portion of the portable actuator in contact with the fixed shutter in an operative position proximate to the permanent magnet on the movable shutter. The movable shutter is then rotated either clockwise or counter-clockwise by sliding the actuator end portion along an arc across the face of the fixed shutter. The permanent magnet is concealed from view by the fixed shutter, thereby preserving its ornamental appearance.

18 Claims, 4 Drawing Sheets

ARCHED WINDOW SHUTTER

BACKGROUND OF THE INVENTION

The present invention relates generally to interior window coverings, and in particular to an arched window shutter assembly including a semi-circular or fan-shaped louvered section mounted for rotation in overlapping relation with a fixed louvered section within an arched frame.

Arched (semi-circular) windows are sometimes installed above doorways and conventional rectangular windows in both residential and commercial buildings. Conventional arched windows are designed to meet both ornamental and functional needs. In addition to the ornamental architectural aspects, arched windows create a feeling of openness, enlarge the outside view and increase the level of natural interior illumination. This is a particularly important consideration in building construction where a minimum ratio of outside window area to inside floor area must be established to meet building code requirements.

In many arched window installations, it is desirable to regulate or limit the amount of sunlight that passes through the arched window. For example, the occupant may desire to cover all windows for privacy purposes, or reduce the ambient light level in a bedroom to accommodate a day sleeper. Additionally, the occupant may desire to cover a window in order to reduce the heat gain produced by direct sunlight in an effort to maintain a comfortable room temperature. Also, it is sometimes desirable to limit or regulate the amount of light passing through the window to avoid bleaching or fading of carpeting and other furnishings caused by extended exposure to direct sunlight.

Various coverings and shutters have been proposed for use in combination with arched windows. Currently popular designs include the fan-type blind and rotary shutters. The following U.S. Patents are representative of the prior art in the field of this invention:

| | | | |
|---|---|---|---|
| 5,713,156 | Briggs, Sr. | 5,159,966 | Fleishman et al |
| 5,662,153 | Rusenblatt | 5,139,070 | Kidd |
| 5,584,329 | Thomas | 5,117,889 | Coe |
| 5,564,229 | Noska | 5,086,822 | Keighler |
| 5,471,789 | Faircloth | 4,776,380 | Lester |
| 5,183,092 | Jelic | 4,699,195 | Lester |
| 5,168,912 | Jelic et al | 4,079,772 | Klaenhammer |

One prior art approach of particular interest is U.S. Pat. No. 5,564,229 issued to Noska. Noska discloses a half-circle window covering for interior installation over an arched window. The window covering includes two fan-shaped shutters, with each shutter being intersected by louver openings arranged in a sunburst pattern. The interior facing shutter is fixed and the exterior facing shutter is mounted for rotation relative to the fixed shutter. According to this arrangement, the louver openings can be aligned with each other to permit the passage of sunlight, and can be rotated to a closed position in which the louver openings are covered.

The position of Noska's movable shutter, which lies behind the fixed interior facing shutter, is adjusted by moving a rotator pin which is attached to the movable shutter and projects through a vertical slot formed through the interior facing shutter. A hand-held rod is coupled to the rotator pin for rotating the movable shutter clockwise and counterclockwise from the open position to the closed position. The control rod remains hanging from the rotator pin after the shutter has been opened or closed, so that it is immediately available for adjusting the shutters to a new position.

A limitation on Noska's shutter arrangement is that the mechanical adjusting components, including the rotator pin, slot and control rod, are conspicuous and detract from the ornamental appearance of the arched window and shutter assembly. Even if the control rod is removed from the rotator pin, the slot and pin remain exposed and visible at all times, regardless of the open or closed position of the shutters. The slot and rotator pin, with or without the control rod, is not in harmony with the ornamental features of the arched window installation and therefore are objectionable on an aesthetic basis.

An adjustable shutter for an arched window installation should meet the following requirements: it should cover the entire window surface, including the arched portions, in the closed shutter position; it should include a sufficient number of apertures arranged in a pleasing pattern which when in the open shutter position will allow a predetermined amount of direct sunlight to pass through the shutter; the open and closed shutter positions should be manually adjustable; the mechanical apparatus providing for operative movement between the open and closed positions should be capable of simple, reliable construction providing many years of maintenance-free service; the position adjustment means should be simple to operate and provide long-term mechanical stability in the open shutter position and in the covered shutter position; the position adjusting apparatus should be concealed so that the ornamental appearance of the shutter assembly is preserved; and, the position adjusting apparatus should be hidden from view so that its existence and its method of operation will be known only to authorized persons.

BRIEF SUMMARY OF THE INVENTION

The shutter assembly of the present invention includes a fixed shutter and a movable shutter coupled to the fixed shutter for rotation between open and closed positions. The fixed shutter includes a semi-circular panel member intersected by a first set of light apertures. The movable shutter includes a semi-circular flat panel member intersected by a second set of light apertures. The movable shutter is pivotally mounted for clockwise and counterclockwise rotational movement relative to the fixed shutter whereby the light apertures are aligned with each other when the movable shutter is in the open position, and the light apertures are covered by overlapping portions of the fixed and movable shutters when the movable shutter is in the closed position.

A magnetically conductive member is attached to the movable shutter for opposite-pole magnetic attraction coupling with a permanent magnet carried on a hand-held, portable actuator. The movable shutter is rotated by placing the actuator end portion of the portable actuator in contact with the fixed shutter in an operative position proximate to the magnetically conductive member on the movable shutter. The movable shutter is rotated either clockwise or counterclockwise by sliding the actuator end portion along an arc across the face of the fixed shutter. The movable shutter is turned by the magnetic attraction force developed by magnetic flux linkage between the hand-held actuator and the magnetically conductive member.

In the preferred embodiment, the magnetically conductive member is a permanent magnet having a magnetic pole facing the fixed shutter. In this arrangement, one of the permanent magnet poles of the portable actuator is disposed in opposite-pole magnetic attraction relationship to the facing magnetic pole on the movable shutter when the actuator end portion of the portable actuator is placed in the operative position. The permanent magnet is concealed from view by the fixed shutter, so that its existence and its method of operation will be known only to authorized persons. Additionally, the magnetically conductive member is hidden from view at all times, thereby preserving the ornamental appearance of the shutter assembly.

BRIEF DESCRIPTION OF THE DRAWINGS

The accompanying drawing is incorporated into and forms a part of the specification to illustrate the preferred embodiments of the present invention. Throughout the drawing, like reference numerals designate corresponding elements. This drawing, together with the description, serves to explain the principles of the invention and is only for the purpose of illustrating exemplary embodiments showing how the invention can best be made and used. The drawing should not be construed as limiting the invention to the illustrated and described embodiments. Various advantages and features of the invention will be understood from the following detailed description taken in connection with the appended claims and with reference to the attached drawing in which:

DETAILED DESCRIPTION OF THE INVENTION

Figure 1:
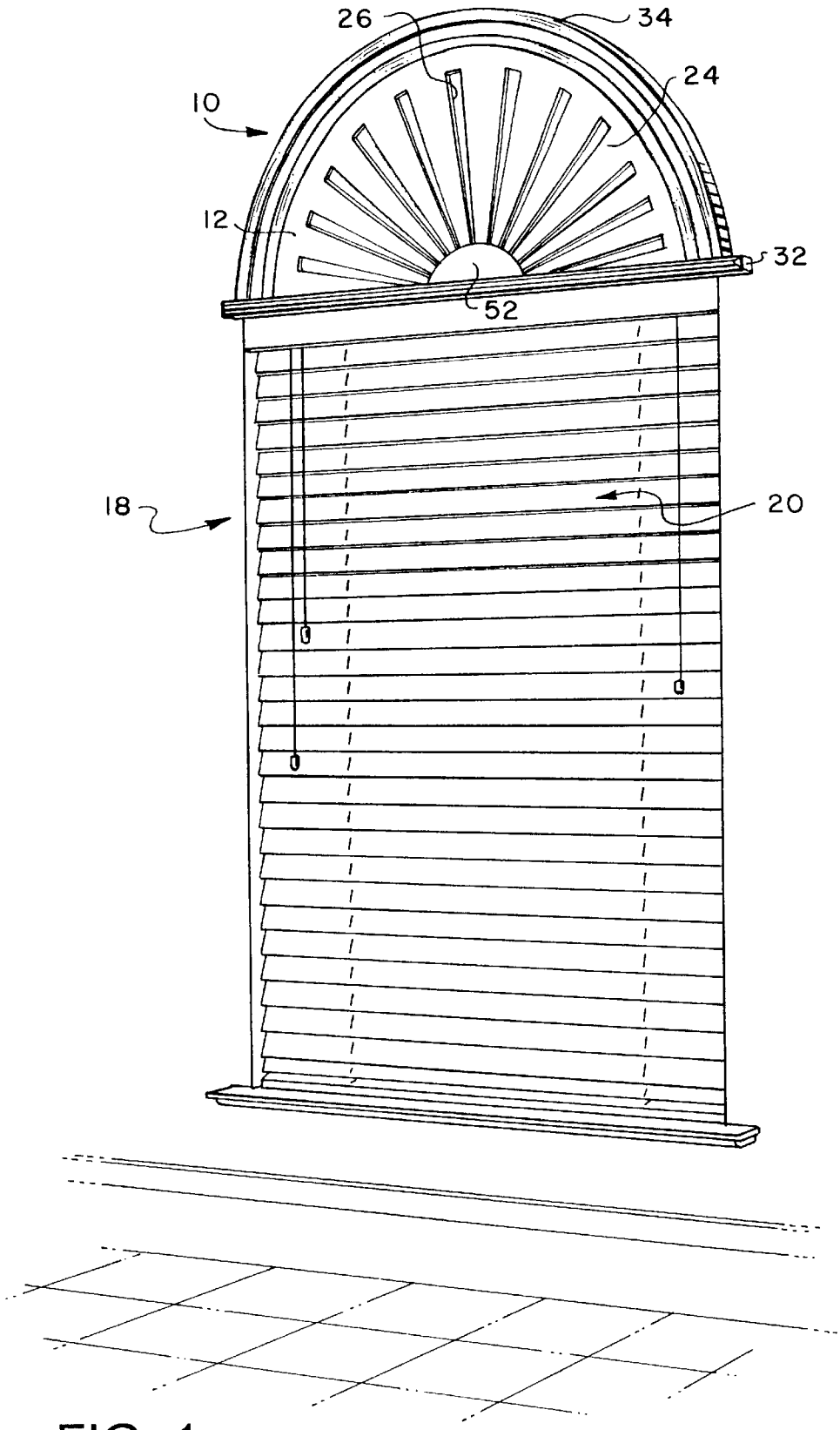
FIG. 1 is a front perspective view of the arched window shutter of the present invention installed in an arched window overlying a rectangular window of a residential building.

A preferred embodiment of the invention is described herein by referring to various examples of how the invention can be made and used. Like reference numerals are used throughout the description and several views of the drawing to indicate like or corresponding parts.

Figure 2:
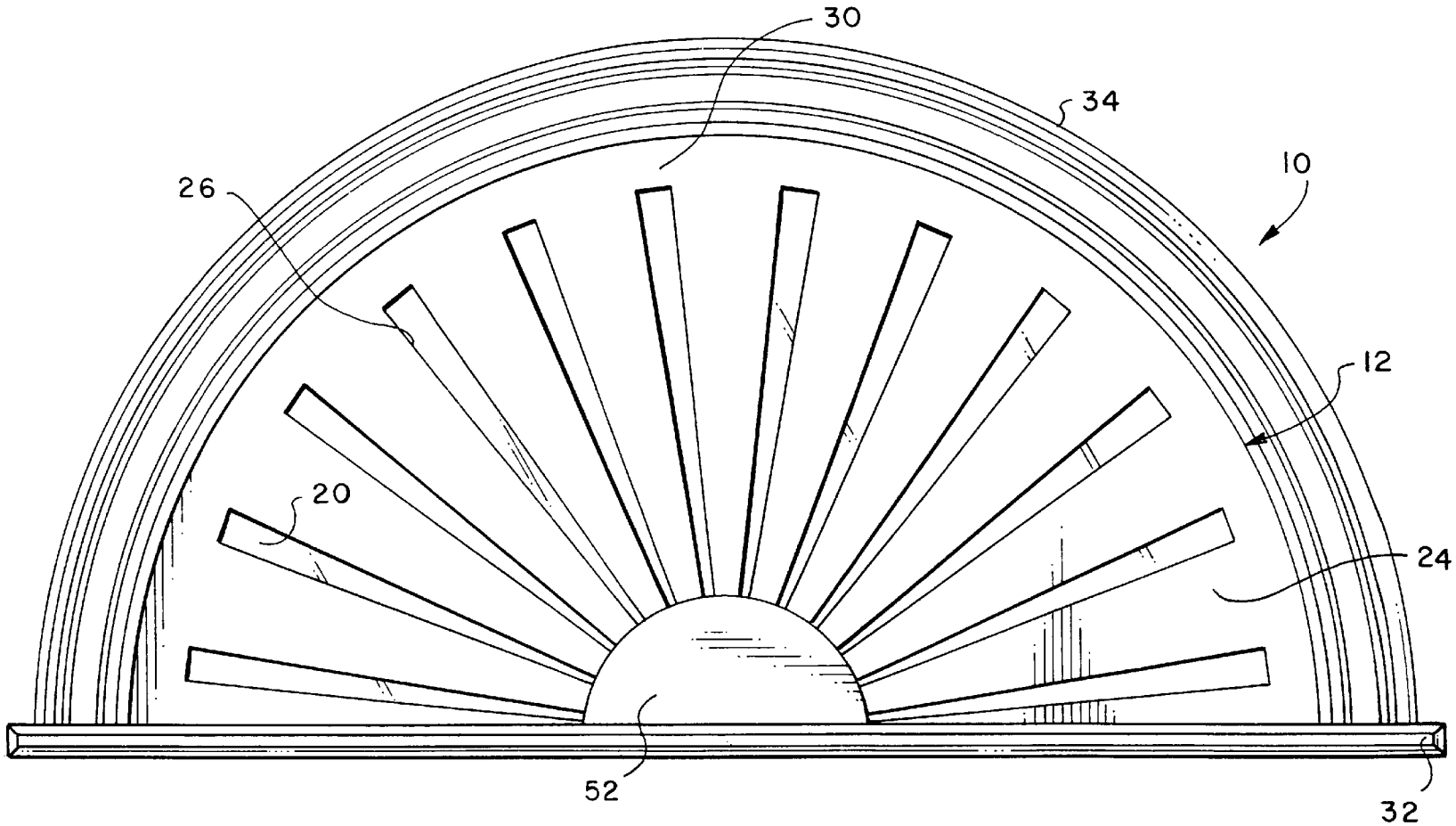
FIG. 2 is a front elevational view of the arched window shutter shown in FIG. 1.
Figure 3:
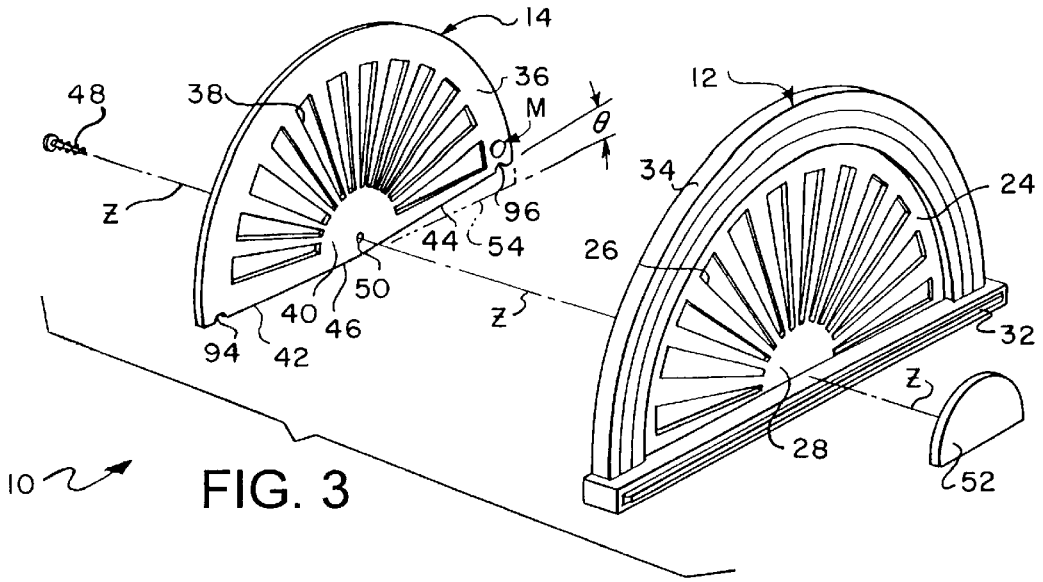
FIG. 3 is an exploded view thereof.

Referring now to FIG. 1, FIG. 2 and FIG. 3, a shutter assembly 10 constructed according to the present invention includes a fixed shutter 12 and a movable shutter 14 mounted on the fixed shutter 12 for rotation between open and closed positions. As shown in FIG. 1, the shutter assembly 10 is mounted across an arched (semi-circular) window 16 (FIG. 4) located directly above a conventional rectangular window 18. In this exemplary embodiment, the arched window 16 and the rectangular window 18 are installed in an outside wall of a residential dwelling.

In this installation, conventional venetian blinds 20 are installed across the rectangular window 18 for regulating or limiting the amount of sunlight that passes through the rectangular window. According to the present invention, an arched shutter assembly 10 is installed across the arched window 16 for partially blocking the entry of direct sunlight when the shutter is in an open position, and completely blocking the passage of sunlight when the arched shutter is in a closed position. As can best be seen in FIG. 2 and FIG. 4, the arched window is sealed by an arched (semi-circular) glass window pane 20, and the rectangular window 18 is sealed by a rectangular glass window pane 22.

Referring again to FIG. 2 and FIG. 3, the fixed shutter 12 includes a semi-circular panel member 24 intersected by a first set of louver apertures 26 that extend radially from a central hub portion 28 to a marginal, semi-circular rim portion 30. The fixed shutter 12 is stabilized by a linear base member 32 and by an arched crown 34. The linear base member 32 and the arched crown 34 are dimensioned for overlapping engagement with the wall structure surrounding the arched window opening. According to this arrangement, the shutter assembly 10 covers the entire window surface, including the arched portions.

The movable shutter 14 includes a semi-circular panel member 36 that is intersected by a second set of light apertures 38 arranged in an identical sunburst pattern, with the louver apertures 38 radiating outwardly and symmetrically from a central hub 40. The semi-circular panel member 36 includes first and second linear base portions 42, 44 that extend transversely with respect to each other, whereby the semi-circular peripheral edge of the panel 36 covers less than 180°. That is, the second lower edge portion 44 is angularly offset with respect to the first lower edge portion 42 by a. small acute angle θ, for example 10°. According to this arrangement, the lower edge portions 42, 44 meet at a common vertex 46. Except for the angular offset of the lower edge portion 44, the movable semi-circular panel member 36 is identical in construction with the semi-circular panel member 24 of the fixed shutter 12.

Figure 5:
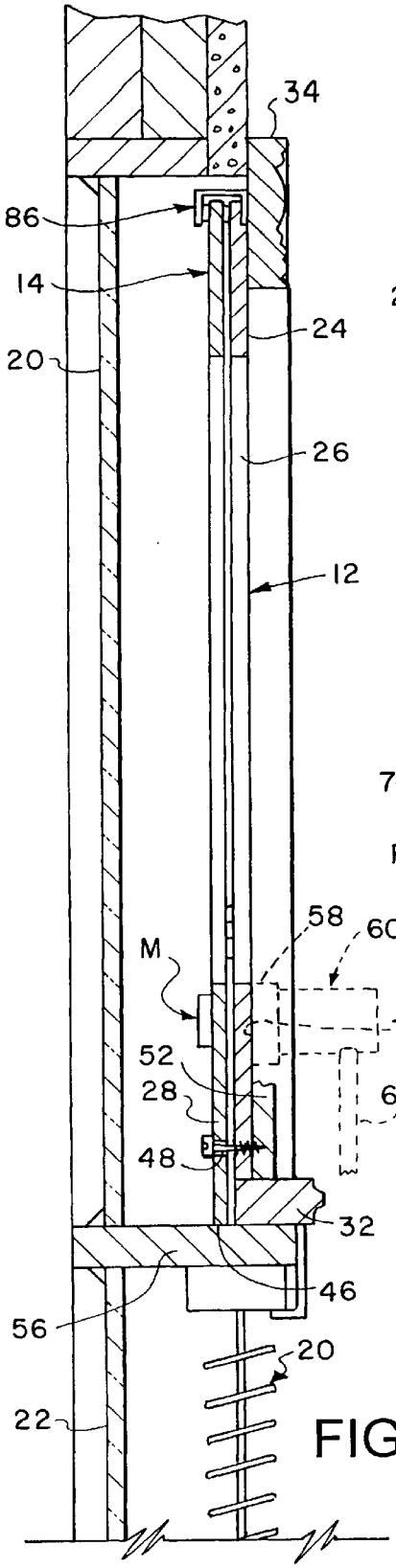
FIG. 5 is a sectional view thereof taken along the line 5—5 of FIG. 4.

Referring now to FIG. 3 and FIG. 5, the movable shutter 14 and the fixed shutter 12 are assembled together in overlapping relation, with the movable shutter being coupled, to the fixed shutter by a pivot shaft 48. In the preferred embodiment, the pivot shaft 48 is a threaded wood screw that extends through a bore hole 50 formed in the central hub 40, with the threaded end of the wood screw being embedded in the central hub 28 of the fixed shutter. Preferably, the wood screw 48 is dimensioned so that it also penetrates and fastens onto an interior hub block 52 which covers the central hub 28 of the fixed shutter.

The movable shutter 14 is rotatable on the smooth shaft portion of the wood screw clockwise and counterclockwise about the longitudinal axis Z of the wood screw 48. It will be appreciated that the movable shutter 14 is stable in the shutter open position, when the lower edge 44 is rotated into alignment with the dashed line 54. Likewise, the position of the shutter 14 is stable in the shutter closed position when its lower edge 42 is moved into contact with the window sill 54 (FIG. 3 and FIG. 5).

The movable shutter 14 is therefore pivotally mounted for clockwise and counterclockwise rotational movement relative to the fixed shutter so that the louver apertures 26, 38 are aligned with each other when the movable shutter is in the open position, and the louver apertures 26, 38 are covered by overlapping facing panel portions of the fixed and movable shutters when the movable shutter is in the closed position. That is, the interior facing shutter 12 is fixed by attachment onto the window sill 54, and completely covers the exterior facing, movable shutter which is supported directly behind the fixed shutter. By this arrangement, the louver apertures 26, 38 can be aligned with each other to permit the passage of direct sunlight, and can be rotated to a closed position in which the louver openings are completely covered.

Figure 8:
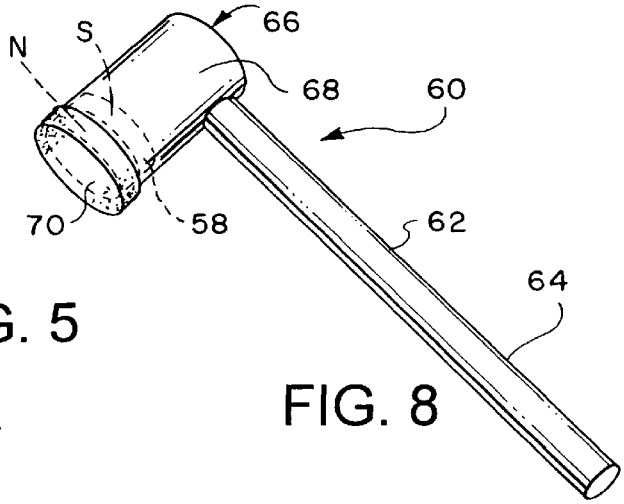

According to an important aspect of the present invention, the shutter position adjusting means is concealed so that the ornamental appearance of the shutter assembly is preserved. Moreover, the position adjusting apparatus is hidden from view so that its existence and method of operation will be known only to authorized persons. For this purpose, a magnetically conductive member M is attached to the movable shutter 14 for magnetic attraction coupling with a permanent magnet 58 mounted on a hand-held, portable actuator 60 (FIG. 8).

The portable actuator includes an elongated handle 62, a hand-grip portion 64 and an actuator end portion 66 mounted on the opposite end of the handle 62. A cylindrical housing 68 is attached to the handle 62. The permanent magnet 58 is fitted within the housing 68 with its north magnetic pole N forming an end face of the actuator. A soft fabric covering 70 is fitted over the hard metal magnetic pole face N to prevent scratching or abrasion of the panel member when the shutter is adjusted.

Referring again to FIG. 5, the portable actuator 60 is placed in an operative position with the magnetic pole N of the magnet 58 being disposed in magnetic attraction coupling with the magnetically conductive member M. The movable shutter 14 is then rotated either clockwise or counterclockwise by sliding the fabric-covered actuator end portion 66 along an arc across the interior face 24 of the fixed shutter. The movable shutter 14 is turned by a magnetic attraction force developed by the magnetic flux linkage between the permanent magnet 58 in the hand-held actuator and the magnetically conductive member M.

Figure 6:
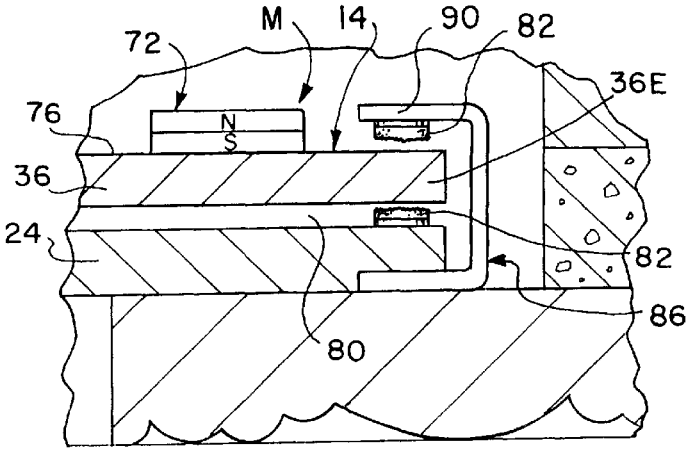
FIG. 6 is a sectional view thereof taken along the line 6—6 of FIG. 4, illustrating the preferred location of a positioning magnet.
Figure 7:
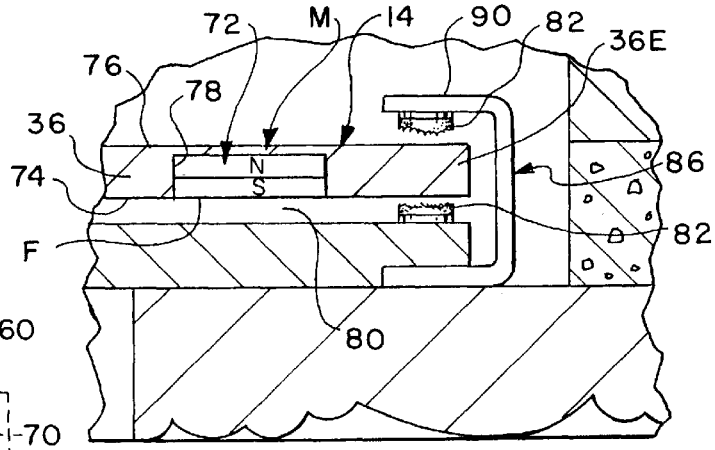
FIG. 7 is a view similar to FIG. 6 showing an alternative placement of the positioning magnet; and, FIG. 8 is a perspective view of a magnetic control handle.

Referring now to FIG. 6 and FIG. 7, the magnetic conductive member is preferably a permanent magnet 72 having an opposite magnetic pole S facing the fixed shutter 12. In this arrangement, the north magnetic pole N of the portable actuator 60 is disposed in opposite-pole magnetic attraction relationship to the facing magnetic south pole S on the movable shutter 14 when the actuator end portion 66 is placed in surface engagement against the fixed shutter panel 24 directly opposite the location of the magnetic member M, which is known only to the operator or other authorized person. According to this arrangement, the magnetically conductive member M is hidden from view at all times, thus preserving the ornamental appearance of the shutter assembly.

Although the magnetic member M is preferably a permanent magnet, the magnetic turning operation of the rotary shutter 14 can be performed where the magnetically conductive member is not magnetized, but is instead simply a metal plate of a ferromagnetic material such as iron, steel or nickel. Moreover, although a cylindrical magnetically conductive member is preferred, as shown in the preferred embodiment, the function of the magnetically conductive member can be performed by a flexible strip of permanently magnetized ferromagnetic material, for example a strip of flexible rubber magnet material of the type sold by Minnesota Mining and Manufacturing Company under its registered trademark PLASTIFORM®.

Referring now to FIG. 5, FIG. 6 and FIG. 7, the semicircular panel member 36 of the movable shutter 14 has a flat, interior facing side surface 74 and an exterior facing side surface 76. In the embodiment shown in FIG. 6, the magnetically conductive member M (permanent magnet 72) is mounted on the exterior facing side surface 76, with the south pole S of the permanent magnet 72 facing toward the fixed shutter 24.

In the embodiment shown in FIG. 7, the interior side surface 74 of the movable shutter 36 is intersected by a pocket 78, and the magnetically conductive member M (the permanent magnet 72) is mounted within the pocket with the external face F of the south magnetic pole S disposed substantially in flush alignment with the interior side surface 74 of the movable shutter. The arrangement of FIG. 7 is preferred, since the distance separating the magnetically conductive member M and the actuator end portion is minimized when the actuator end portion 66 is placed in the operative position (FIG. 5).

Referring again to FIG. 6 and FIG. 7, the movable shutter 14 is positioned in close overlapping relation with the fixed shutter 12 across a small axial air gap 80. The air gap 80 is maintained by a plurality of glide pads 82 that are disposed between the overlapping panel surfaces of the fixed shutter and the movable shutter.

Figure 4:
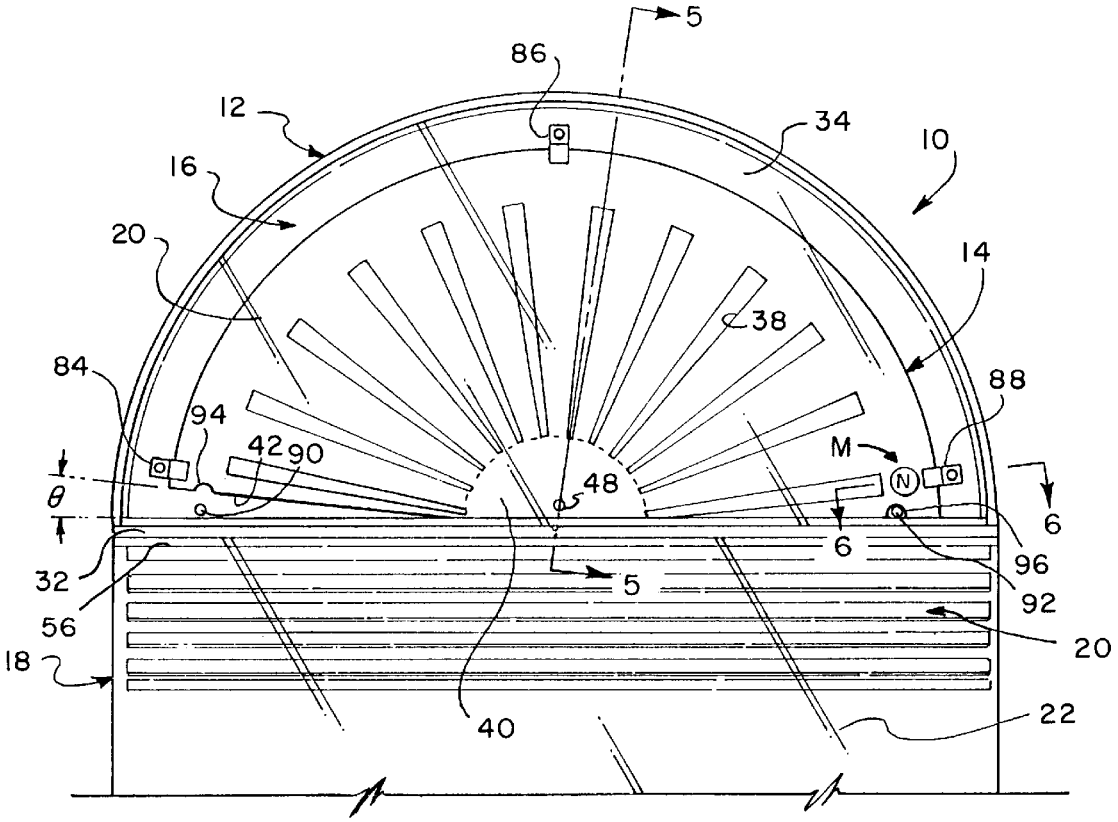
FIG. 4 is a rear elevational view of the arched window installation shown in FIG. 1.

The movable shutter 14 is further stabilized for rotation with respect to the fixed shutter 12 by a plurality of retainer brackets 84, 86 and 88 (FIG. 4). Referring again to FIG. 5 and FIG. 6, each bracket includes a retainer arm portion 90 projecting across a marginal edge portion 36E of the movable shutter. A glide pad 82 is attached to the underside of each retainer arm and is disposed for surface engagement against the exterior side surface 76 of the movable shutter.

Referring now to FIG. 4 and FIG. 5, the fixed shutter is mounted on the linear base member 32, with the semicircular panel member 36 being framed by the arched crown 34. The movable shutter 14 is pivotally coupled to the central hub portion 28 so that its lower linear edge portion 42, 44 can be rotated into alignment with the lower edge of the linear base member 32. Clockwise and counterclockwise rotation of the movable shutter 14 is limited by first and second limit pins 90, 92, preferably in the form of wood screws, that project from the exterior facing side surface of the fixed shutter. The linear base portions 42, 44 are intersected by notches 94, 96, respectively, for receiving the limit pins 90, 92 at the limit of counterclockwise and clockwise rotation, respectively.

Although the invention has been described with reference to certain exemplary arrangements, it is to be understood that the forms of the invention shown and described are to be treated as preferred embodiments. Various changes, substitutions and modifications can be realized without departing from the spirit and scope of the invention as defined by the appended claims.

I claim:

1. A shutter assembly for installation across a window comprising:

a fixed shutter including a fixed panel portion for blocking the passage of light and an aperture for permitting the passage of light;

a movable shutter disposed in overlapping relation with the fixed shutter and mounted for movement to an open position and to a closed position relative to the fixed shutter aperture;

a magnetically conductive member rigidly attached to the movable shutter at a location that is overlapped by the fixed panel portion;

a portable actuator including a permanent magnet for magnetic attraction coupling with the magnetically conductive member when the actuator is placed in an operative position proximate to the fixed panel portion; and the movable shutter including an interior side surface facing the fixed shutter, and the magnetically conductive member including a flat face portion disposed substantially in flush alignment with the interior side surface of the movable shutter.

2. A shutter assembly as set forth in claim 1, wherein the magnetically conductive member is a permanent magnet.

3. A shutter assembly as set forth in claim 1, wherein the magnetically conductive member comprises a ferromagnetic plate.

4. A shutter assembly as set forth in claim 1, wherein the magnetically conductive member comprises a flexible strip of permanently magnetized ferromagnetic material.

5. A shutter assembly as set forth in claim 1, the movable shutter including an interior side surface facing the fixed shutter, the interior side surface being intersected by a pocket and the magnetically conductive member being disposed within the pocket.

6. A shutter assembly as set forth in claim 1, the movable shutter including an interior side surface facing the fixed shutter and an exterior side surface, and the magnetically conductive member being mounted on the exterior side surface of the movable shutter.

7. A shutter assembly as set forth in claim 1, including a plurality of glide pads disposed between overlapping surfaces of the fixed shutter and the movable shutter for maintaining a substantially uniform air gap between the fixed shutter and the movable shutter.

8. A shutter assembly as set forth in claim 1, further comprising:

a pivot shaft attached to the fixed shutter; and, the movable shutter being mounted on the pivot shaft for clockwise and counterclockwise rotational movement relative to the fixed shutter.

9. A shutter assembly as set forth in claim 1, including:

a plurality of retainer brackets mounted on the fixed shutter, each bracket including a retainer arm portion projecting across a marginal edge portion of the movable shutter.

10. A shutter assembly as set forth in claim 9, including a glide pad attached to each retainer arm and disposed for surface engagement against the exterior side surface of the movable shutter.

11. A shutter assembly as set forth in claim 1, wherein:

the fixed shutter including a linear base portion and an arched crown portion; and, the shutter assembly further comprising:

first and second retainer pins mounted on the base portion and projecting transversely with respect to the movable shutter;

the movable shutter including first and second base portions extending transversely relative to each other, the first and second base portions being intersected by first and second notches, respectively; and, the first and second limit pins being received in the first notch and in the second notch, respectively, when the movable shutter is disposed in the open position and in the closed position, respectively.

12. A shutter assembly as set forth in claim 1, wherein:

the fixed shutter including a flat panel member intersected by a first set of light apertures;

the movable shutter including a flat panel member intersected by a second set of light apertures; and, the louver apertures of the first and second sets being aligned with each other when the movable shutter is in the open position, and the louver apertures of the first and second sets being covered by overlapping portions of the fixed and movable shutters when the movable shutter is in the closed position.

13. A shutter assembly as set forth in claim 1, wherein:

the fixed shutter including a linear base portion, an arched crown portion and a semi-circular panel member disposed between the linear base portion and the arched crown portion; and, the movable shutter including a semi-circular panel member disposed in overlapping relation with the fixed semi-circular panel member.

14. A shutter assembly as set forth in claim 1, the portable actuator further comprising:

an elongated handle including a hand-grip portion and an actuator end portion for engaging the fixed shutter in the operative position; and, an actuator housing attached to the actuator end portion and projecting transversely with respect to the hand grip position, the permanent magnet being mounted within the actuator housing with one of its magnetic poles disposed for magnetic attraction coupling with the magnetically conductive member when the portable actuator is placed in the operative position.

15. A shutter assembly for installation across a window opening comprising:

a fixed shutter including a linear base portion, an arched crown portion mounted on the linear base portion and a first semi-circular panel member disposed between the linear base portion and the arched crown portion;

a movable shutter coupled to the fixed shutter for rotational movement relative to the fixed shutter, the movable shutter including a second semi-circular panel member disposed in overlapping relation with the fixed semi-circular panel member, and the first and second semi-circular panel members being intersected by first and second sets of light apertures, respectively;

a permanent magnet rigidly attached to the movable shutter;

the first semi-circular panel member of the fixed shutter including a continuous panel portion overlapping the permanent magnet during movement of the movable shutter to the open position and to the closed position; and, a portable actuator including a permanent magnet having a magnetic pole disposed for opposite-pole magnetic attraction coupling with the permanent magnet on the movable shutter when the portable actuator is placed in an operative position proximate to the fixed shutter.

16. A shutter assembly for interior installation across a window opening comprising, in combination:

a fixed shutter including a flat panel member intersected by a first set of light apertures;

a movable shutter disposed in overlapping relation with the fixed shutter, the movable shutter including a flat panel member intersected by a second set of light apertures;

the movable shutter being mounted for movement to an open position in which light apertures of the first and second sets are aligned with each other, and to a closed position in which light apertures of the first and second sets are covered by overlapping portions of the flat panel members;

a magnetically conductive member disposed on the movable shutter; and, a portable actuator including a handle, an actuator end portion attached to the handle and a permanent magnet disposed on the actuator end portion for magnetic coupling with the magnetically conductive member when the actuator end portion is placed in an operative position proximate to the fixed shutter.

17. A window shutter assembly as set forth in claim 16, wherein:

the flat panel member of the fixed shutter including a continuous panel portion overlapping the magnetically conductive member during movement of the movable shutter to the open position and to the closed position.

18. A window shutter assembly as set forth in claim 16, wherein the magnetically conductive member is a permanent magnet having a magnetic pole facing the fixed shutter, and wherein one of the permanent magnet poles of the portable actuator is disposed in opposite-pole magnetic attraction relationship to the facing magnetic pole on the movable shutter when the actuator end portion of the portable actuator is placed in the operative position.

* * * * *